US006805084B2

(12) United States Patent
Artmann

(10) Patent No.: US 6,805,084 B2
(45) Date of Patent: Oct. 19, 2004

(54) CONNECTABLE BUCKET TAPPET

(75) Inventor: Jens Artmann, Regendorf (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/759,316

(22) Filed: Jan. 16, 2004

(65) Prior Publication Data

US 2004/0144350 A1 Jul. 29, 2004

Related U.S. Application Data

(63) Continuation of application No. PCT/EP02/06615, filed on Jun. 15, 2002.

(30) Foreign Application Priority Data

Jul. 19, 2001 (DE) ..... 101 35 175

(51) Int. Cl.[7] ..... F01L 1/14
(52) U.S. Cl. ..... 123/90.48
(58) Field of Search ..... 123/90.48, 90.5, 123/90.52, 90.53, 90.55

(56) References Cited

U.S. PATENT DOCUMENTS 4,762,100 A * 8/1988 Kowal ..... 123/90.58
6,233,706 B1 * 5/2001 Ahrikencheikh et al. ... 714/724

FOREIGN PATENT DOCUMENTS

| | | |
|---|---|---|
| DE | 44 44 698 | 8/1995 |
| DE | 197 30 200 | 1/1999 |
| DE | 199 51 052 | 5/2000 |
| DE | 199 13 290 | 9/2000 |

* cited by examiner

*Primary Examiner*—Bibhu Mohanty
(74) *Attorney, Agent, or Firm*—Ostrolenk, Faber, Gerb & Soffen, LLP

(57) ABSTRACT

A connectable bucket tappet having a ring shaped section and avoiding a receiving element for a coupling device which was previously joined thereto in a single piece. A separate, sleeve-shaped component is arranged near the base of the ring shaped section. The component is used for sectionally accommodating a slider for coupling the ring shaped section to a central circular section.

16 Claims, 1 Drawing Sheet

CONNECTABLE BUCKET TAPPET

CROSS-REFERENCE TO RELATED APPLICATION

This is a continuation application of PCT/EP02/06615 filed Jun. 15, 2002, which PCT application claims priority of German application number 101 35 175.5 filed Jul. 19, 2001. The PCT International application was published in the German language.

FIELD OF THE INVENTION

The invention relates to a connectable bucket tappet for a valve drive of an internal combustion engine, having a ring shaped section which has a skirt for oscillatory mounting in a holder of an internal combustion engine and, in its bore, accommodates a circular section such that it can move axially, it being possible for the two sections to be coupled to each other in at least one axial displacement position in relation to each other via at least one slider which can be displaced radially or in the manner of a secant and which runs in the circular section in the uncoupled state, holders for the slider being provided in the region of bases of the sections and an outer surface of the circular section being enclosed by at least one compression spring which, at one end, acts against the base of the ring shaped section and, and the other end, acts against a support of the circular section which is remote from the base.

BACKGROUND OF THE INVENTION

A bucket tappet of this type is previously known from U.S. Pat. No. 5,651,335. In this, two sliders are arranged in the vicinity of the base of the circular section and, for the coupling case, can be displaced radially outward into a corresponding holder of a ring shaped section. The disadvantage in the case of the generic tappet is that, in particular, its ring shaped section is relatively complicated to produce. This is based on the fact that its holders are connected thereto in one piece. The relatively massive transverse web present in the ring shaped section in order to form the holders makes fabrication, in particular chip-free fabrication, of the ring shaped section relatively expensive. Furthermore, it must be noted that only a relatively short compression spring can be used as a lost-motion spring because of the transverse webs.

OBJECT OF THE INVENTION

It is therefore an object of the invention to provide a connectable tappet of the aforementioned type in which the cited disadvantages are eliminated with simple means.

SUMMARY OF THE INVENTION

According to the invention, this object is achieved by the holder of the ring shaped section being formed as a separate, sleeve-like component, which extends only over a small part of an annular width of the ring shaped section and runs with its inner edge immediately in front of the outer surface of the circular section, the component being enclosed at least sectionally by the compression spring radially on the outside and in the axial direction of the bucket tappet.

By means of these aforementioned simple measures, it is possible to dispense with the transverse web disadvantageously present in the prior art. Thus, production of the ring shaped section of the tappet is considerably less complicated and therefore cheaper than in the prior art. At the same time, the installation space for the compression spring as a lost-motion spring is increased. As a result if necessary, the tappet height can be reduced or a greater relative stroke of the sections in relation to one another can be produced. Precisely as a result of these measures according to the invention, relatively simple chip-free fabrication for the ring shaped section is suggested. Although, radial webs on the base side in the ring shaped section are not dispensed with completely, these are formed merely like weak ribs and are used to support an annular part of the compression spring as a lost-motion spring and, if appropriate, as a subdivision for two separate hydraulic fluid chambers.

Preferably, the intention is to apply only one slider arranged in the circular section. However, two sliders are also conceivable, which can be displaced radially outward for a coupling purpose. In this case, two diametrically opposite, sleeve-like components then have to be applied in the ring shaped section.

Thought is given in particular to a piston or pin as slider. However, a large number of further coupling elements, such as pawls, balls, wedges and the like, are also conceivable.

The sleeve-like component has only a low depth and is preferably produced from a sheet metal material. Here, a simple deep-drawing method is suggested for its production. If appropriate, a plastic or other lightweight component can also be used.

The sleeve-like component has at least one vent opening, which will not be explained in more detail, or a vent duct, in order to avoid the undesired build-up of an air cushion during the coupling operation.

According to a further feature, the annular extension from the inner edge of the base of the ring shaped section is used firstly for excellent guidance of the circular section in the ring shaped section. Secondly, it has a radial opening for the simple fixing of the sleeve-like component.

Furthermore, it is a further feature to produce a simple antirotation safeguard for the sections in relation to one another by an inner edge of the sleeve-like component, which communicates with a flat on the outer surface of the circular section. Of course, those skilled in the art will discover still further antirotation measures of a form-fitting type.

The fact that the slider is loaded in a displacement direction, preferably in the coupling direction, via at least one helical spring enclosing the latter, means that the holder for the slider in the circular section needs have only a relatively short length. Otherwise, the helical spring would have to be applied to the end of the slider. However, it is also conceivable to load the slider in the coupling direction via compression spring force and to displace it in the uncoupling direction via hydraulic means. If appropriate, other displacement means such as electromagnetic, magnetic and the like can also be used.

The radial webs originating from the base of the ring shaped section are used, as mentioned, for the contact of an annular part. Thus, two segment-like spaces for hydraulic fluid can be implemented, at least one chamber being used for the feed line of the hydraulic fluid in front of one end of the slider. The further chamber can be connected hydraulically to the first-named chamber. However, it can also be used as a supply chamber for the supply of an optionally applied hydraulic play compensating element in the circular section. If appropriate, the slider or the hydraulic element can be supplied virtually directly with hydraulic fluid from the cylinder head via a bore in the skirt.

BRIEF DESCRIPTION OF THE DRAWING

The invention is expediently explained in m,ore detail using the drawing.

DETAILED DESCRIPTION OF THE DRAWING

Figure 1:
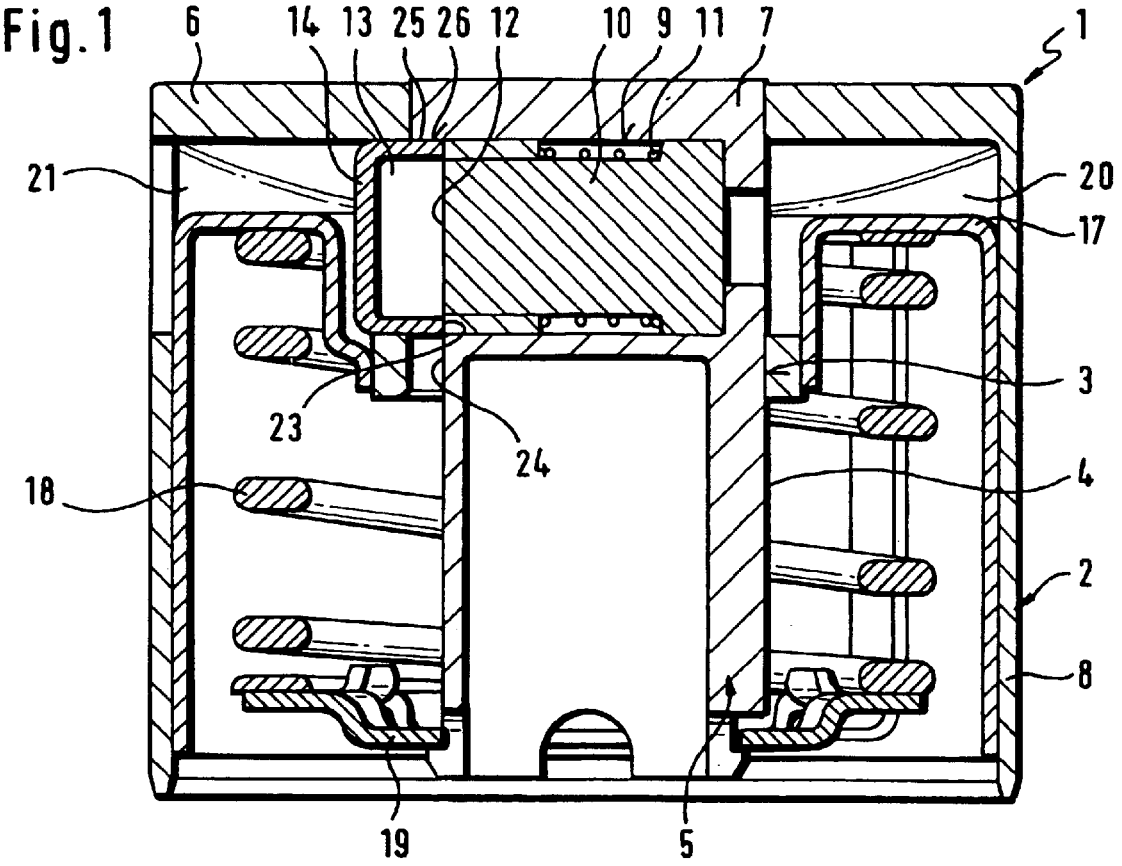
FIGS. 1, 2 show the bucket tappet according to the invention in longitudinal sections offset through 90° with respect to each other.

The two Figures disclose a connectable bucket tappet 1 which comprises a ring shaped section 2 which bore 3 therein, which accommodates a circular section 5 with its outer surface 4 such that it can move axially. The two sections 2, 5 each have respective base 6, 7 for a cam contact. In this case, the base 6 is loaded by a cam (not shown) with a greater stroke than the base 7. Furthermore, the ring shaped section 2 has a skirt 8, via which the bucket tappet 1 can be mounted in a holder of a cylinder head of an internal combustion engine, not shown.

The circular section 5 has, in the vicinity of its base 7, a holder 9 running radially here for holding a piston-like slider 10. The slider 10 is sectionally enclosed by a helical spring 11. The spring is used to displace the slider 10 in the uncoupling direction i.e., back into the holder 9. A holder 13 lies opposite one end 12 of the slider 10 in the region of the base 6 of the ring shaped section 2 during a basic circular pass of the cam. The holder 13 is produced as a sleeve-like component 14 and has an only relatively short depth. The component 14, produced of deep-drawn sheet metal, for example, runs in an annular extension 15 which extends from an inner edge 16 of the base 6 of the ring shaped section 2 in the direction away from the base.

Figure 2:
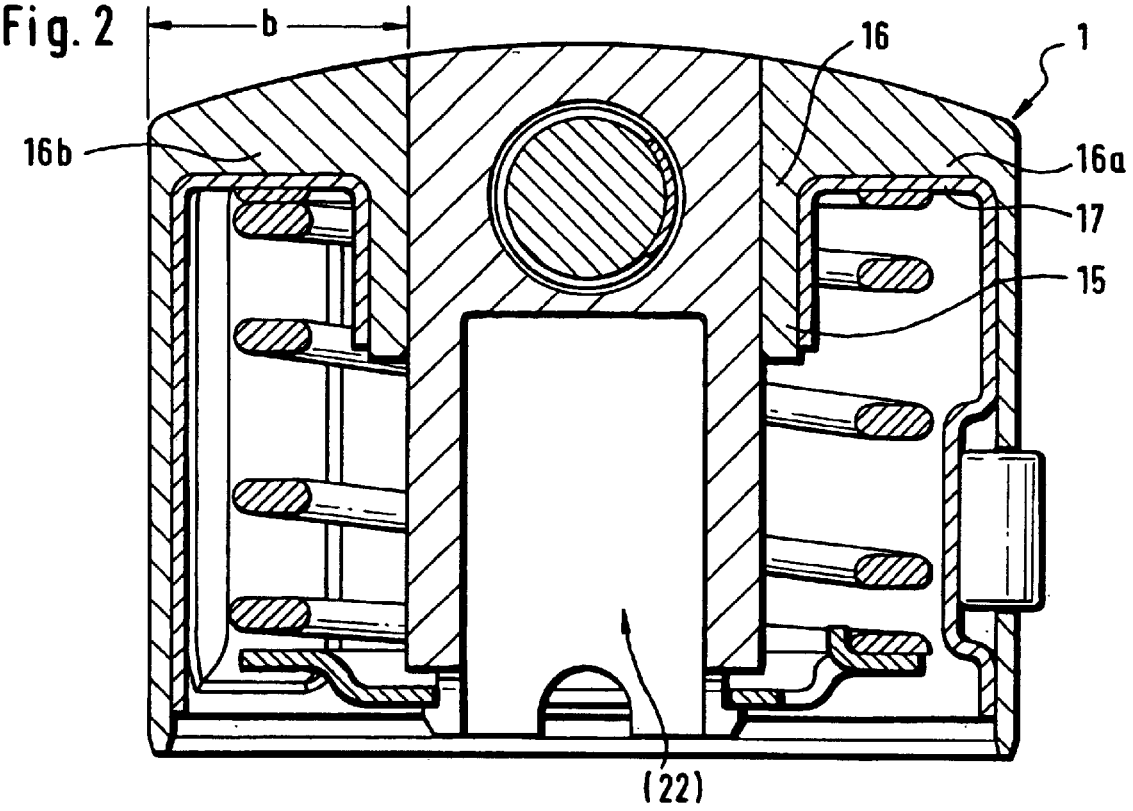

As shown in FIG. 2, two diametrically opposite radial webs 16*a*, 16*b* originate from the base 6 of the ring shaped section 2. These are used firstly to stiffen the entire ring shaped section 2 and secondly for the contact of an annular part 17, of funnel-like geometry here. On this annular part 17, at one end there bears a compression spring 18 which, at the other end, is mounted on a support 19 connected to the circular section 5. The compression spring 18 is also designated a lost-motion spring.

Furthermore, FIG. 1 reveals that, between the base 6 and the annular part 17, chambers 20, 21 like circular segments subdivided by the radial webs 16 are formed. In any case, the chamber 20 is used as a supply chamber for hydraulic fluid for displacing the slider 10 in the coupling direction, that is to say sectionally into the sleeve-like component 14. The chamber 21 can be connected hydraulically to the chamber 20, but it can also be used as a supply chamber for supplying a hydraulic play compensating element 22 arranged in the circular section 5.

The outer surface 4 of the circular section 5 has a flat 24 in the peripheral region of an inner edge 23 of the component 14. This provides a simple antirotation safeguard of the ring shaped with respect to the circular section 2, 5.

FIG. 1 also discloses that a surface section 25 of the component 14, on the side of the base, jointly with an overhang 26 engaging over said component and belonging to the circular section 5, forms an axial stop for the ring shaped with respect to the circular section 2, 5.

Only one central slider 10 in the circular section 5 is illustrated. Located opposite the latter is the thin-walled component 14, provided with only a very low depth, in the ring shaped section 2. On the basis of this design, it is possible to dispense with the holder for the slider or the sliders previously to be recorded in the prior art and connected in a complicated manner in one piece to the ring shaped section 2. Thus, the production operation for the ring shaped section 2 is relatively simple and economical, just using the chip-free method. Furthermore, it can be seen that, as a result of the low depth of the component 14, this is surrounded sectionally by the compression spring 18.

Thus, a greater compression spring length can be implemented or, as described in more detail in the introduction to the description, the total height of the connectable bucket tappet 1 can be shortened.

What is claimed is:

1. A connectable bucket tappet for use in a valve drive of an internal combustion engine, the tappet comprising:

a ring shaped section having an outer skirt for enabling oscillatory mounting of the skirt in a holder of the engine; the ring shaped section having a bore within the ring shaped section;

a circular section accommodated in the bore of the ring shaped section in a manner such that the circular section is movable axially with respect to the ring shaped section to axial displacement positions, and the ring shaped section and the circular section having at least one axial displacement position in relation to each other at which the ring shaped section and the circular section may be coupled to each other;

a slider operable between positions for coupling the ring shaped section and the circular section and for uncoupling those sections, the slider being shaped to run in the circular section while in the uncoupled state and the slider being displaceable from the circular section in a direction which moves the slider into the ring shaped section in which the slider couples the ring shaped section and the circular section;

both of the ring shaped section and the circular section having a base; a first holder for the slider in the region of the base of the circular section, a second holder for the slider in the region of the base of the ring shaped section, wherein the slider is shaped and moveable so that in an uncoupled state, the slider is out of the second holder in the ring shaped section but in a coupled condition, the slider is moved to be in both the first holder in the circular section and the second holder in the ring shaped section for coupling the sections;

the circular section having an outer surface, a compression spring enclosing the outer surface, the compression spring having a first end which acts against the base of the ring shaped section and having a second end which acts against a portion of the circular section remote from the base thereof;

the second holder of the ring shaped section is a separate component which extends only over a small part of the annular shape of the ring shaped section, and the second holder has an inner edge at the outer surface of the circular section;

the second holder being enclosed at least sectionally by the compression spring located radially outside of the component and the axial direction of the bucket tappet.

2. The bucket tappet of claim 1, wherein the slider is displaceable with respect to the central section radially thereof or in the manner of a secant.

3. The bucket tappet of claim 1, wherein the second holder of the ring shaped section is comprised of a separate sleeve component which is open for receiving the slider therein and the sleeve component is enclosed at least sectionally by the compression spring radially on the outside of the component.

4. The bucket tappet of claim 3, wherein the slider is provided in the circular section and has a piston geometry and the sleeve component of the ring shaped section is in the form of a thin walled pot for receiving the slider and is opposite the slider.

5. The bucket tappet of claim 4, where there is one slider.

6. The bucket tappet of claim 5, wherein the base of the ring shaped section has a radially inner edge region and has an annular extension extending in the axial direction of the bucket tappet and away from the base and defining the bore of the ring shaped section in which the circular section is disposed, the annular extension extending over a portion of the height of the bucket tappet and the annular extension also being shaped for accommodating the sleeve component of the second holder.

7. The bucket tappet of claim 1, wherein the second holder has a base side toward the base of the ring section and has a surface section at the base side, an overhang reaching over the sleeve component of the second holder and attached to the circular section and positioned for forming an axial stop for the ring shaped section with respect to the circular section.

8. The bucket tappet of claim 1, wherein the circular section has an outer surface with a region thereof in a region of the sleeve component of the second holder, the outer surface includes a flat, and the sleeve component of the second holder having an inner edge which bears on the flat.

9. The bucket tappet of claim 1, further comprising a helical spring enclosing the slider and loading the slider in the uncoupling direction.

10. The bucket tappet of claim 9, further comprising a device in the tappet for loading the slider in the coupling direction against the force of the helical spring.

11. The bucket tappet of claim 1, wherein the component of the second holder is comprised of a lightweight structural material.

12. The bucket tappet of claim 1, wherein a support for the first end of the compression spring against the base of the ring shaped section comprises a thin walled annular part;

diametrically opposite, thin-walled radial webs positioned for the annular part to bear thereagainst.

13. The bucket tappet of claim 12, wherein the radial webs are diametrically opposite and are also offset by approximately 90° in the circumferential direction with respect to the component of the second holder originating from the base of the ring shaped section.

14. The bucket tappet of claim 13, further comprising first and second chambers defined in the annular region between the ring shaped section and the circular section, each chamber being shaped as a respective circular segment, and at least one of the chambers being adapted for containing hydraulic fluid.

15. The bucket tappet of claim 14, wherein the at least one chamber is in connection with the first holder for the slider so that the slider is loaded with hydraulic pressure in the at least one chamber.

16. The bucket tappet of claim 1, further comprising a hydraulic play compensating element in the circular section.

* * * * *